US005907595A

United States Patent [19]

Sommerer

[11] Patent Number: 5,907,595

[45] Date of Patent: May 25, 1999

[54] EMITTER-CUP CATHODE FOR HIGH-EMISSION X-RAY TUBE

[75] Inventor: Timothy John Sommerer, Ballston Spa, N.Y.

[73] Assignee: General Electric Company, Schenectady, N.Y.

[21] Appl. No.: 08/912,268

[22] Filed: Aug. 18, 1997

[51] Int. Cl.[6] ..... H01J 35/06

[52] U.S. Cl. ..... 378/136; 378/119

[58] Field of Search ..... 378/136

[56] References Cited

U.S. PATENT DOCUMENTS 4,205,254 5/1980 Kanai .
4,344,011 8/1982 Hayashi et al. .
4,868,842 9/1989 Dowd .
4,894,853 1/1990 Dowd ..... 378/136
5,060,254 10/1991 de Fraguier et al. ..... 378/136
5,617,464 4/1997 Mika et al .

*Primary Examiner*—Craig E. Church
*Attorney, Agent, or Firm*—Jill M. Breedlove; Douglas E. Stoner

[57] ABSTRACT

An x-ray tube has at least one approximately planar electron emitter and an emitter-cup cathode configured to provide an electron beam of substantially greater perveance and beam compression ratio than otherwise obtainable with conventional cathode designs. The cup is optimized for use in a line-focus, planar-anode tube and has a slot in which the emitter is situated, an adjacent face region which is planar and angled so as to properly form the initial electron beam, a recess to allow the initial electron beam to be accelerated without significant shaping, and an overhanging portion which completes the electron beam forming.

14 Claims, 5 Drawing Sheets

EMITTER-CUP CATHODE FOR HIGH-EMISSION X-RAY TUBE

BACKGROUND OF THE INVENTION

The present invention relates generally to x-ray tubes and, more particularly, to a cathode configuration therefor.

Presently available medical x-ray tubes typically include a cathode assembly having an emitter and a cup. The cathode assembly is oriented to face an x-ray tube anode, or target, which is typically a planar metal or composite structure. The space between the cathode and anode is evacuated.

A disadvantage of typical cathode designs is that the emitter, which typically comprises a helically coiled tungsten wire filament, tends to be rather large and electrons are emitted radially outward from all surfaces of the filament surface. The cup, therefore, must be designed to produce a very tailored electric potential distribution in the vacuum such that all electron trajectories are redirected from their initial divergent motion toward a very small focal spot on the anode surface. For design purposes it is usually sufficient to treat the coiled filament as a solid emitting cylinder, and to neglect detail at the level of individual turns of the coil. It is also usually sufficient to be concerned only with the focal spot width, rather than its complete two-dimensional shape because the focal spot length can be more-or-less independently set by emitter-cup changes which do not strongly alter the width. However, even with this design freedom, it is difficult in practice to design a cup which produces such tailored electric fields and leads to a small focal spot width. The present state-of-the-art is represented by filament coils of major diameter around 1 millimeter which can be focused onto a 0.1 millimeter-wide focal spot on the anode, i.e., a beam compression ratio of 10.

A universal limitation of electron emitters is that the net emission current as measured between the cathode and anode cannot be increased without bound simply by increasing the primary emission current of the emitter. As used herein, primary emission denotes electrons leaving the emitter surface and does not include any electrons which return to the surface. More precisely, the net emission current density at the emitter is limited. The net emission current is the primary emission current less any electron current returning to the emitter surface. At very low primary emission current density, corresponding to low heating current and low emitter temperature for a thermionic emitter, the net emission current density will increase in nearly direct proportion to any increase in primary emission current density. Conversely, at very high primary emission current density, the electron density immediately in front of the emitter surface is so high that the self-charge of the electron cloud completely counteracts the electric field at the emitter surface caused by the cathode-anode potential difference. This latter condition is referred to as a saturated emitter; further increases in primary current density do not appreciably increase the net emission current. Between these two extremes is a smooth transition where increases in primary emission current density lead to less than proportionate increases in net emission current, and practical x-ray tubes often operate in this transition regime. All electron emitters are limited by this fundamental process, independent of the emitter material and emission mechanism. A useful figure-of-merit for characterizing the overall capability of a cathode is its perveance, defined as the ratio $I/V^{3/2}$, where I is the net electron current and V is the potential difference between the cathode and anode. Additionally, the self-charge of the electrons in the vacuum can alter the electric potential and can cause undesirable changes such as enlargement of the focal spot size, sometimes referred to as blooming. Thus, cathode designs which are capable of meeting design goals on net current and yet which operate far below their inherent saturation current density can be advantageous. Finally, there is ordinarily a tradeoff between the useful life of a thermionic emitter and its operating temperature such that it can be desirable to operate the emitter at a lower temperature, and hence a lower primary emission current density.

A further disadvantage of typical cathode designs is that the cup design needed to properly focus the electrons results in a significant reduction in the saturation current of the cathode, and hence the maximum obtainable x-ray emission over that which would be expected if the filament were operated in free space apart from the cup. In particular, the aforementioned requirement that the initial, radially directed electron distribution from a helical coil filament be redirected onto the small focal spot leads one to place the filament emitter into a rather narrow slot. Unfortunately, this reduces the electric field normal to the front surface of the filament significantly below the average electric field present in the cathode-anode gap, which is on the order of V/L. Here, V is the electric potential between the cathode and anode, and L is the cathode-anode spacing. The electric field strength normal to the emitter surface, in the absence of any electron emission, determines the saturation current density of each point on the filament surface. Further, the electric field strength normal to the emitter surface is highest only on that portion of the filament which is closest to the anode; it decreases away from this one point; hence, the saturation current density decreases away from this one particular location. In principle, the emitting area may always be increased to obtain a higher total emission current, but as noted hereinabove, it is difficult to increase the filament size without also undesirably increasing the focal spot size.

A further limitation of conventional filament-cup cathode designs is that it is quite difficult in practice to form anything resembling a laminar electron beam wherein the trajectories of electrons emitted from various locations on the filament do not cross each other as they move from the cathode to the anode As a result, the spatial distribution of current density across the width of the focal spot on the anode surface is not the gaussian distribution which would lead to the best modulation transfer function and hence the best image quality. Instead, the focal spot current distribution is typically double-peaked. The peak electron current density within the focal spot on the target is limited by the peak temperature capability of the anode. Therefore, to the extent that the actual peak current density exceeds that of an otherwise equivalent gaussian spatial distribution for a given anode design, the total current, and hence the maximum achievable x-ray fluence, will be reduced. It is not necessary that the electron flow be close to laminar in order to create the desirable gaussian spatial distribution of electron current, but the highly nonlaminar nature of the electron beam created by conventional filament-cup cathode designs makes the formation of a gaussian focal spot quite difficult in practice.

An emitter-cup cathode which simultaneously provides higher emission current, smaller focal spot width, and better modulation transfer function has been heretofore unavailable. This has been disadvantageous in, for example, medical x-ray tubes for mammographic imaging applications. Because of the desired low-energy x-ray spectrum for these applications, the electric field between the cathode and anode is relatively low (e.g., a 30 kilovolt potential difference applied over a cathode-anode gap of 7 millimeters), and the corresponding saturation current can be quite low, leading to low x-ray intensity and long exposure times. Further, mammographic imaging demands some of the smallest focal spot sizes among all medical applications in order to reliably detect microcalcifications indicative of the earliest stages of breast cancer.

Accordingly, it is desirable to provide an emitter-cup x-ray tube cathode which overcomes the hereinabove described disadvantages.

SUMMARY OF THE INVENTION

An x-ray tube comprises at least one approximately planar electron emitter and an emitter-cup cathode configured to provide an electron beam of substantially greater perveance and beam compression ratio than otherwise obtainable with conventional cathode designs. The cup is optimized for use in a line-focus, planar-anode tube and comprises a slot in which the emitter is situated, an adjacent face region which is planar and angled so as to properly form the initial electron beam, a recess to allow the initial electron beam to be accelerated without significant shaping, and an overhanging portion which completes the electron beam forming.

DETAILED DESCRIPTION OF THE INVENTION

Figure 1:
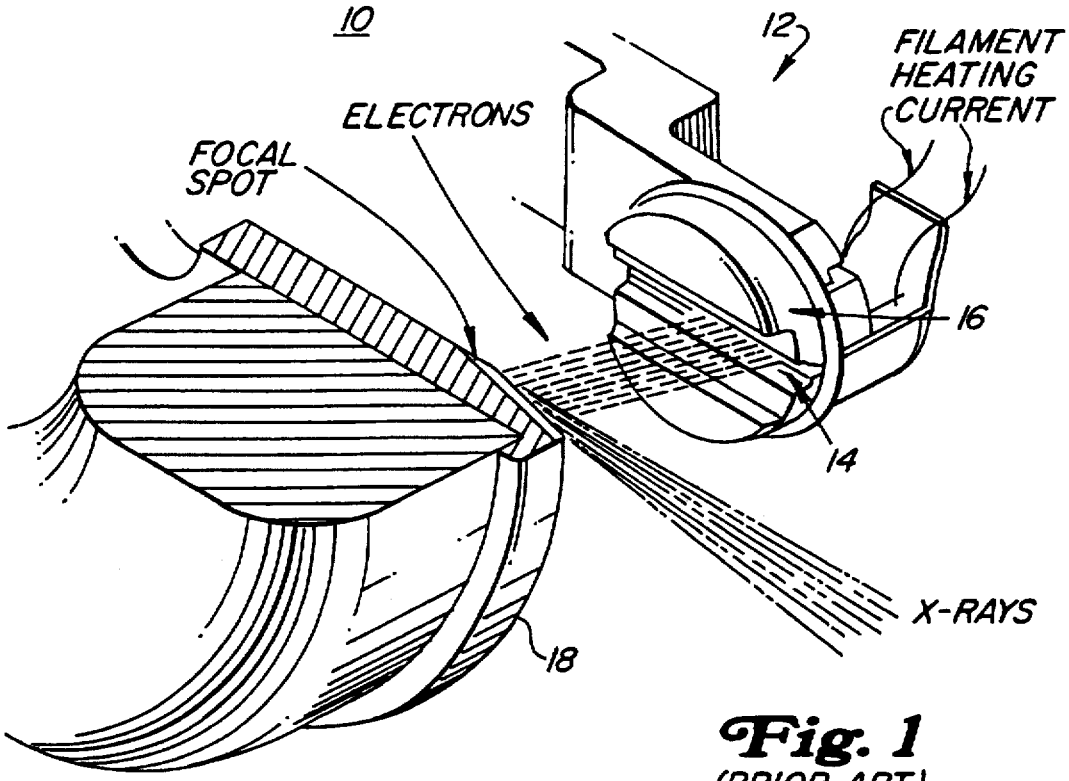
Fig. 1 (PRIOR ART)
FIG. 1 is a perspective view of a conventional x-ray tube cathode design.
Figure 2:
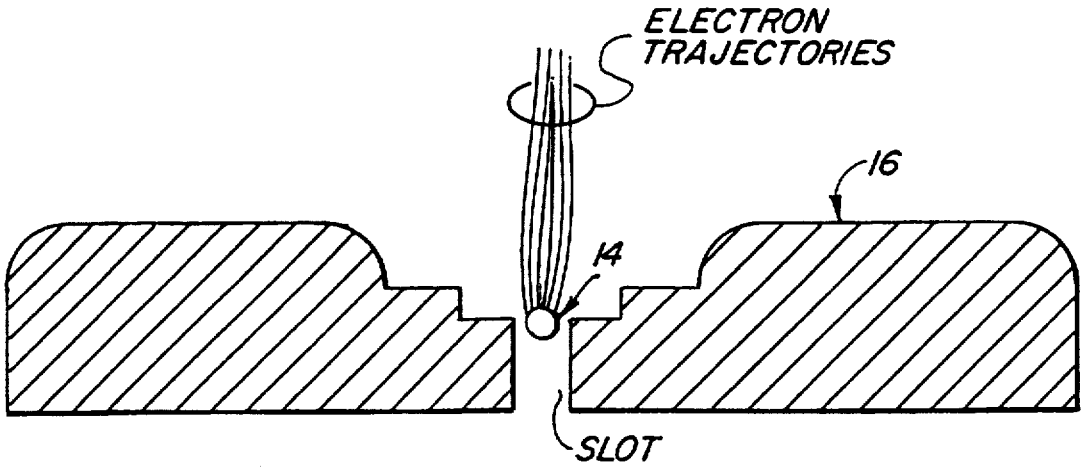
Fig. 2 (PRIOR ART)
FIG. 2 is a cross sectional view of the x-ray tube of FIG. 1.

FIGS. 1 and 2 illustrate a conventional x-ray tube 10 including a cathode 12 having an emitter 14 and a cup 16. Cathode 12 is oriented to face an x-ray tube anode 18, or target, which is typically a planar metal or composite structure. For many applications wherein high x-ray flux is required, the anode itself is a disk which is rotated at a high speed (typically 1000 to 10,000 revolutions per minute) in order to keep the peak anode temperature in the focal spot to an acceptable value. The cathode assembly is typically held from 20 to 200 kilovolts negative with respect to the anode. The space, or air gap, between the cathode and anode is evacuated to improve the voltage standoff capability of the gap and reduce scattering by electron-atom collisions. Emitter 14 is typically a helically coiled tungsten wire filament which is heated by passing an electric current of several amperes through the wire to a temperature sufficient for thermionic emission of electrons. Emitter 14 is set into cup 16. The potential difference between the cathode and anode accelerates the thermionically emitted electrons to the desired kinetic energy, and guides them to a suitable line focus on the anode, where x-rays are then generated by brehmsstrahlung and other processes which are characteristic of the anode material. The shape of the cup is chosen so as to form the desired electron beam cross section as it impacts the anode, i.e., the focal spot size and shape. The electric potential in the vacuum may be altered further through the application of an electric potential, or bias, between the emitter and the cup. Practical cathode assemblies are designed to produce the best compromise between total emission current, focal spot line width, and other measures of performance.

Figure 3:
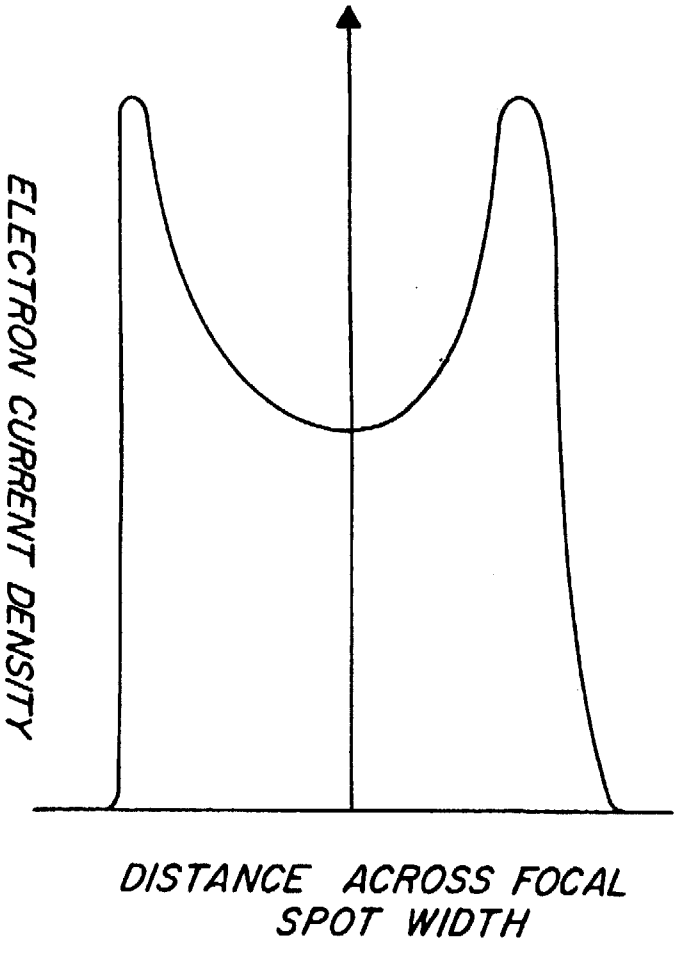
FIG. 3 graphically illustrates an exemplary focal spot profile showing the spatial distribution of electron current at the anode surface of a conventional x-ray tube such as that illustrated in FIGS. 1 and 2.

FIG. 3 graphically illustrates the double-peaked focal spot current distribution typical of conventional filament-cup designs such as that illustrated in FIG. 1. As explained hereinabove, this is the result of the highly nonlaminar nature of the electron beam created by such conventional filament-cup cathode designs which makes the formation of a gaussian focal spot current distribution quite difficult in practice.

Figure 4:
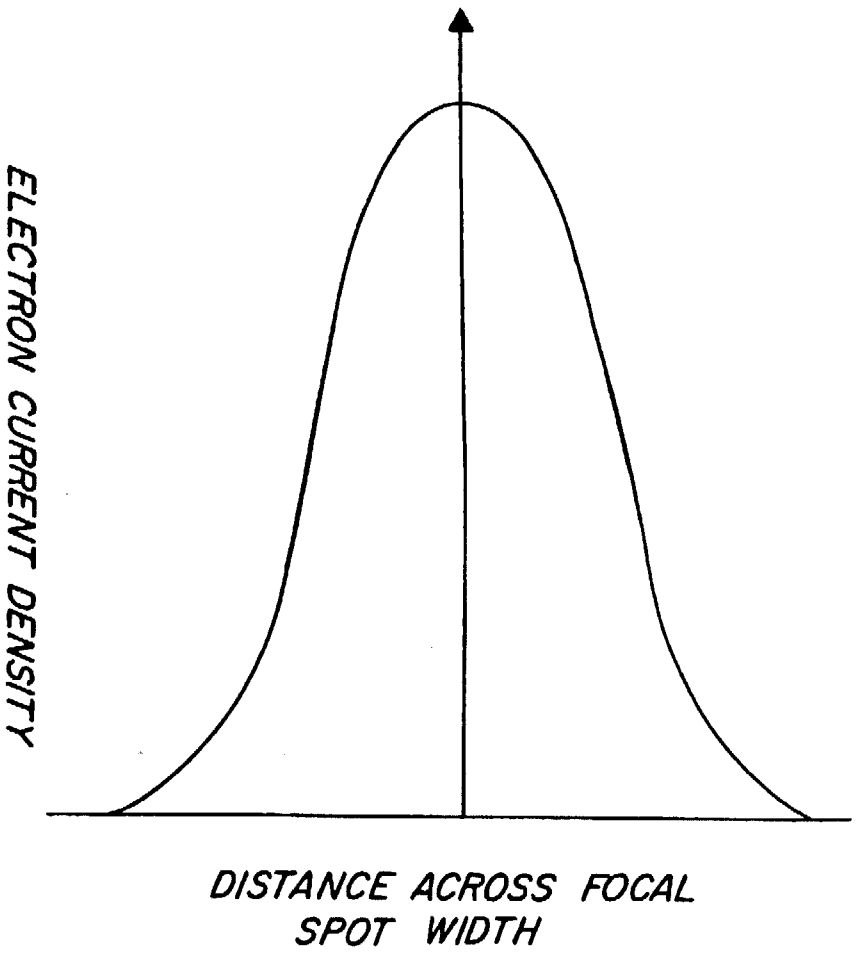
FIG. 4 graphically illustrates the approximately gaussian focal spot profile for an x-ray tube constructed according to a preferred embodiment of the present invention.

In accordance with preferred embodiments of the present invention, an emitter-cup cathode configuration is provided which produces an approximately gaussian focal spot current distribution. FIG. 4 graphically illustrates such a desirable gaussian focal spot current distribution which would lead to the best modulation transfer function and hence the best image quality for x-ray imaging.

Figure 5:
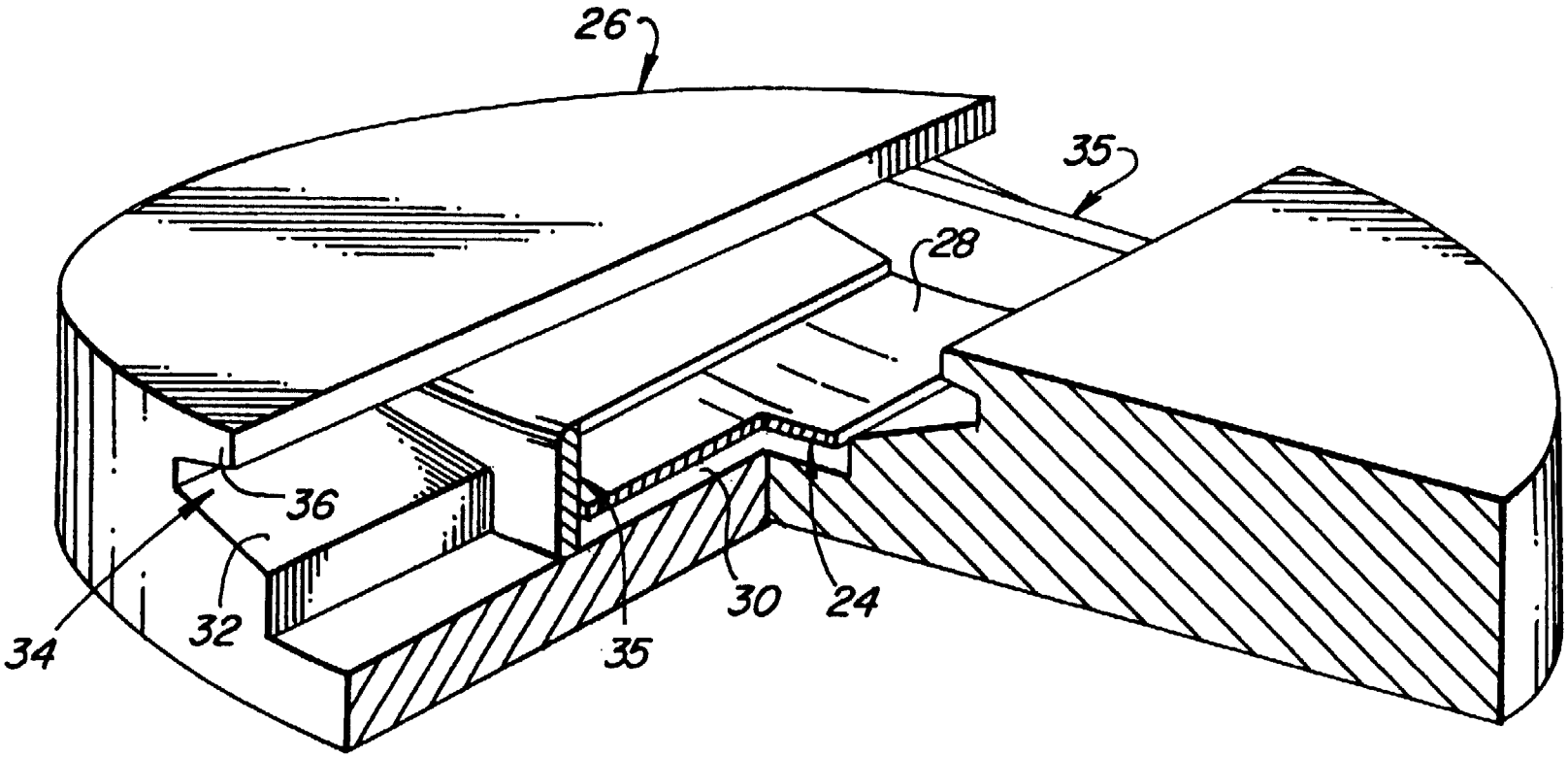
FIG. 5 is a perspective view of an emitter-cup cathode according to a preferred embodiment of the present in vention.
Figure 6:
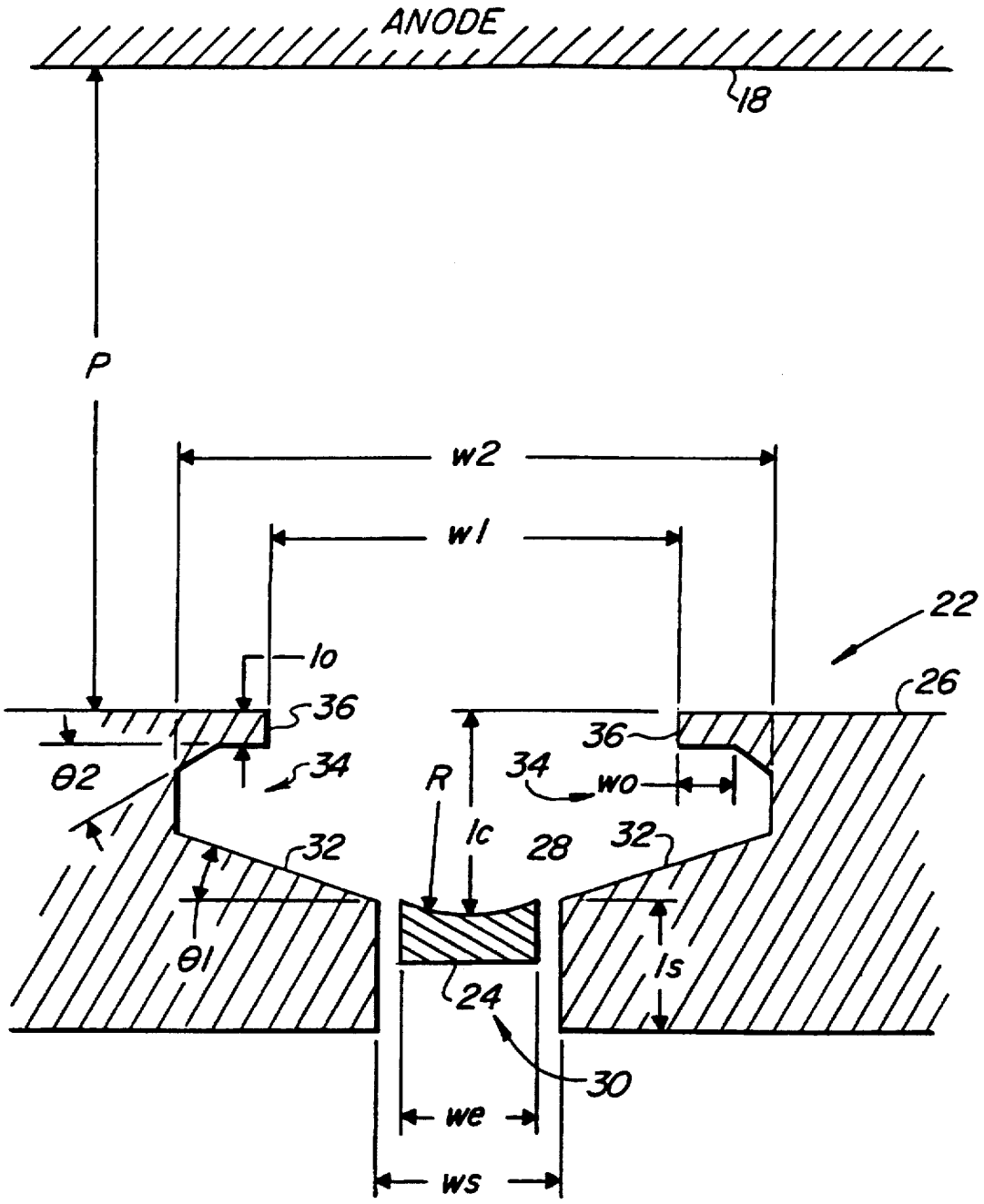
FIG. 6 is a cross sectional view of the emitter-cup cathode of FIG. 5.

FIGS. 5 and 6 illustrate an emitter-cup x-ray tube cathode 22 in accordance with a preferred embodiment of the present invention. Cathode 22 comprises an emitter 24 set into a cup 26. In accordance with a preferred embodiment of the present invention, at least one side of the emitter has an approximately planar shape with an emitting area on the order of several square millimeters. "Approximately planar", as used herein, means a shape distinct from a coiled wire filament, but not necessarily flat. That is, the surface might have some curvature.

One advantage of an approximately planar emitter, as opposed to a conventional coiled filament, is that the electrons emitted from one face travel in roughly the same direction (normal to the face), whereas electrons emitted from a coil (or even a portion, e.g., one-half, of a coil) have little organized net collective motion. In both cases, however, the motion of the electrons is not entirely collective since there is a random component arising from the finite emitter temperature. With a coiled filament, shaping the electric potential so as to gather all the divergent electron trajectories into a small focal spot is quite difficult, whereas with an approximately flat emitter, the electron trajectories are already generally in the proper direction, and the electric potential need only perturb the trajectories to create the same focal spot.

Any suitable emitter material and mode of electron emission may be used with an emitter-cup cathode of the present invention. One example of a suitable emitter material is tungsten foil having a thickness in an exemplary range from one to several mils. Tungsten foil offers the advantages that it can be precisely shaped, patterned, and otherwise manipulated using suitable metal-forming techniques; and it can be heated resistively by passing electric current through the tungsten or by an indirect method so as to emit electrons by the thermionic mechanism.

In the embodiment of FIGS. 5 and 6, emitter 24 is shown as a generalized block with a slightly concave front surface 28 of constant radius R. The emitter block is set into cup 26.

The emitter and cup face a target surface which is held at some positive electric potential with respect to the emitter, typically 20–200 kilovolts for medical imaging applications, for example. Electrons produced by the emitter are accelerated by the potential difference and hit the anode 18, where both characteristic and braking x-radiation are produced.

In many conventional medical x-ray tubes, the anode is not an idealized point or line, or even the perforated anode of a practical electron gun; rather, it approximates a plane. For an approximately planar anode, the electric field lines are normal to the anode surface, instead of extending more-or-less radially outward from the desired focal spot, and the cathode will need to more strongly converge the electron trajectories than would be the case if the anode more closely approximated a point or line.

The embodiment of FIGS. 5 and 6 illustrates a cup configuration optimized for use in a line-focus, planar-anode x-ray tube. It comprises the following: emitter 24, a slot 30 in which the emitter is situated, an adjacent face region 32 which is planar and angled to so as to appropriately form the initial electron beam, a recess 34 to allow the initial electron beam to be accelerated without significant shaping, and an overhang 36 for completing formation of the electron beam forming. Emitting surface 28 can be set approximately flush with the face to maximize the electric field at the emitting surface, and hence maximize the saturation current. Tabs 35 control the length of the focal spot, but are not part of this invention for reasons mentioned previously. The entire cup geometry is held substantially at a single fixed potential and produces a close approximation of the desirable laminar, homocentric, homogeneous electron beam.

By way of illustration, the various portions of the emitter-cup can be viewed as performing independent manipulations of the electron trajectories. The concave shape of emitting surface 28 ensures that the initial electron motion is toward the focal spot, i.e., to the extent that can be achieved with the initial thermal distribution of electron velocities. Face region 32 shapes the electric potential along the edges of the electron beam. Recess 34 then allows the electrons to be accelerated to a significant fraction (e.g., 10 to 30%) of their final speed without significant steering perturbations, at which point overhang 36 is used to perform the final beam manipulation on the medium-energy electron beam. Beyond the overhang, the electron momentum is sufficiently high that further guidance is neither necessary nor particularly productive, and the electrons are accelerated by the remaining cathode-anode potential difference until they reach the focal spot.

Advantageously, the embodiment of FIGS. 5 and 6 results in a small focal spot width for an emitter having a given width, or more generally, a given surface area, thus resulting in a high beam compression ratio.

As an example, dimensions for the emitter-cup configuration of FIGS. 5 and 6 which allow electron emission from a 3 millimeter wide emitter to be accelerated across a 30 kilovolt potential difference and focused onto a focal spot of width on the order of 50 micrometers (full width at half maximum), for an overall beam compression ratio on the order of 60:1 are as follows:

we=3 mm
ws=3.4 mm
ls=2 mm
θ1=15 degrees
θ2=12 degrees
R=8 mm
lc=2.5 mm
wo=0.4 mm
lo=0.4 mm
w1=5.6 mm
w2=7.4 mm
d=7 mm Any further significant increase in the beam compression ratio in this example is limited by the random thermal motion of the electrons which accounts for more than half the 50 micrometer focal width.

Figure 7:
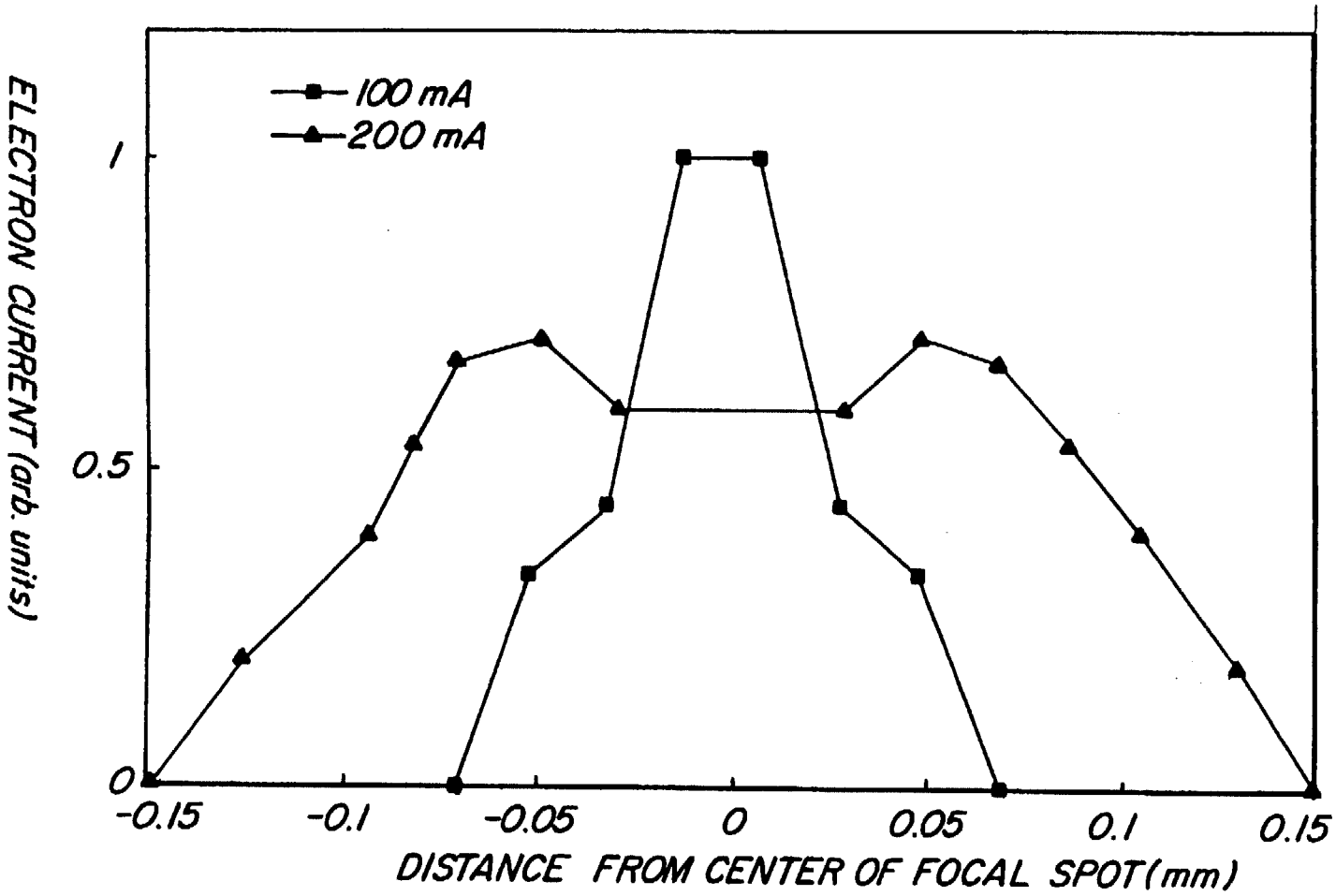
FIG. 7 graphically illustrates focal spot spatial profiles obtained from an emitter-cup cathode such as those of FIGS. 5 and 6.

FIG. 7 graphically illustrates focal spot spatial profiles obtained from an emitter-cup cathode such as that of FIGS. 5 and 6. The predicted focal spot shape for net currents of 100 milliamps and 200 milliamps are shown in FIG. 7, and the majority of the focal spot width can be attributed to the intrinsic thermal motion of the electrons rather than the inability of the emitter-cup configuration to produce a true line focus.

The focal spot profiles shown in FIG. 7 were determined via a computer simulation. The simulation starts with a geometric definition of the cathode-anode geometry which can be approximated as a two-dimensional cross section like that shown in FIG. 6 to simulate a line focus for the physical reasons described hereinabove. (Alternatively, cylindrical symmetry can be assumed in order to simulate a design intended to produce a point focus.) The cathode and anode surfaces are assumed to be perfect conductors at specified electric potentials. The intervening space is discretized, and the electric potential in this region is determined by a second-order finite element method. Pseudoelectrons, each representing a large number of real electrons, are launched from each elemental area of the emitting surface with a distribution of initial direction and energy so as to mimic the thermal distribution of emitted electrons. The pseudoelectron trajectories are integrated until they intersect a metal surface, usually the anode. An iterative procedure follows, where the electron self-charge in each element of the discretized mesh is determined from knowledge of the pseudoelectron trajectories; then electric potential is recalculated. This iteration continues until a preset convergence criterion is reached. Once converged, the spatial distribution of the electron current at the focal spot can be reconstructed from the pseudoelectron trajectories. This simulation procedure has the usual practical advantages over actual fabrication of design test vehicles, and it is quantitatively accurate both because all important physical properties are known, and because the solution of the electric potential and pseudoelectron trajectories can be made arbitrarily accurate by well-known procedures.

The general emitter-cup configuration shown in FIG. 6 was first determined by estimating its dimensions and by computing focal spot profiles. Final dimensions were determined using a fractional factorial designed experiment to explore the effect of changes of six key dimensions on the focal spot width and shape. The dimensions given in the example hereinabove were optimized to minimize focal spot width at a net current of 100 milliamps.

A cathode according to the present invention may be advantageously refined further to meet requirements of image protocols which demand more than one net current and focal spot size. Still further, such a cathode may be designed to produce a relatively small focal spot width for low beam currents and to produce a larger focal spot for higher tube currents, thereby managing the peak thermal stress on the target.

Several additional advantages of the general emitter-cup cathode configuration of the present invention have been identified as follows. The anode itself need not be solid, but can be perforated to allow the electron beam to be further manipulated and utilized. A notable advantage over electron guns is that the anode is a simple plane, and the entire cathode/anode arrangement requires only one electric potential difference (i.e., between the cathode and anode), or two potential differences if a bias is applied, rather than a more complicated electrode arrangement. A typical x-ray tube has several modes of operation, one of them being a high resolution mode, where the focal spot width is minimized, and a separate high brightness mode, where the net current is maximized. Because of the limitations of conventional cathodes like that shown in FIG. 1, these two operating modes are often accommodated by placing two (or more) filaments in the cathode structure, a smaller one to deliver the small focal spot size mode, and a larger one capable of meeting the requirements of the high-brightness mode. The emitter-cup cathode configuration of the present invention is better capable of accommodating both operating modes using a single emitter. Higher net current is possible because the emitting area, saturation current, and perveance of this new emitter-cup cathode configuration are all significantly higher than can be achieved with conventional designs. The small-spot mode is possible from the same large emitter because, compared with conventional designs, this invention can achieve significantly higher beam compression ratios. A significant advantage of using one emitter rather than two, beyond the reduction in mechanical complexity, is that the focal spots produced in the two operating modes are centered at the same physical location on the anode; that is, the focal spots are coincident. Good coincidence is required for certain medical imaging protocols, and a single emitter design avoids the potential for misalignment in a two-filament cathode design. A further operational advantage can be achieved by this design because, in practice, the focal spot size in the high-brightness mode is usually larger than the focal spot size in the small-spot mode in order to accommodate the thermal limitations of the anode surface. This variable focal spot size can be achieved straightforwardly in the present invention by allowing focal spot blooming to occur in a controllable manner in the high-brightness mode. For the configuration shown in FIG. 5, increasing the electron current from 50 milliamps to 100 milliamps and then to 200 milliamps causes the focal spot width to increase, as shown in FIG. 7, thereby offsetting in part the increase in heating power density at the anode surface. If deemed necessary, a relatively small potential difference (bias) can be applied between the emitter and the cup as another degree of freedom to tailor the focal spot size and shape for a particular application.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. An x-ray tube for generating x-ray radiation, comprising:

an anode;

a cathode opposing the anode and spaced apart therefrom, the cathode being maintained during operation of the x-ray tube at a negative potential with respect to the anode, the cathode comprising an emitter for emitting an electron beam to a focal spot on the anode during operation of the x-ray tube;

an emitter-cup having sidewalls and a slot defined by the sidewalls for situating the emitter therein, the emitter-cup being configured to shape and accelerate the electron beam and guide the electron beam to the focal spot on the anode, the emitter-cup having planar wall faces extending at a predetermined angle from the sidewalls of the emitter-cup, which planar wall faces extend into a recess region of the emitter-cup, the emitter-cup having an overhanging portion which overhangs and bounds the recess region.

2. The x-ray tube of claim 1 wherein the emitter has an approximately planar emitting surface.

3. The x-ray tube of claim 1 wherein the emitter-cup is configured such that the focal spot comprises a line focus.

4. The x-ray tube of claim 1 wherein the emitter-cup is configured such that the focal spot comprises a point focus.

5. The x-ray tube of claim 1 wherein the emitter-cup is configured to provide a relatively small focal spot for low electron beam currents, and to provide a larger focal spot for higher electron beam currents.

6. The x-ray tube of claim 1 wherein an additional potential difference is applied between the emitter and the emitter-cup.

7. The x-ray tube of claim 1 wherein the anode comprises a perforated anode through which the electron beam may pass.

8. An emitter-cup for an x-ray tube cathode, the cathode comprising an emitter for emitting an electron beam to a focal spot on an x-ray tube anode for production of x-ray radiation, comprising:

an emitter-cup having sidewalls and a slot defined by the sidewalls for situating the emitter therein, the emitter-cup being configured to shape and accelerate the electron beam and guide the electron beam to the focal spot on the anode, the emitter-cup having planar wall faces extending at a predetermined angle from the sidewalls of the emitter-cup, which planar wall faces extend into a recess region of the emitter-cup, the emitter-cup having an overhanging portion which overhangs and bounds the recess region.

9. The emitter-cup of claim 8 wherein the emitter has an approximately planar emitting surface.

10. The emitter-cup of claim 8 configured such that the focal spot comprises a line focus.

11. The emitter-cup of claim 8 configured such that the focal spot comprises a point focus.

12. The emitter-cup of claim 8 configured to provide a relatively small focal spot for low electron beam currents, and to provide a larger focal spot for higher electron beam currents.

13. The emitter-cup of claim 8 wherein an additional potential difference is applied between the emitter and the emitter-cup.

14. The emitter-cup of claim 8 wherein the anode comprises a perforated anode through which the electron beam may pass.

* * * * *